US009080368B2

(12) United States Patent
Razzaboni et al.

(10) Patent No.: US 9,080,368 B2
(45) Date of Patent: Jul. 14, 2015

(54) DISPOSABLE CONTAINER FOR VALUABLE ITEMS AND MACHINE FOR FILLING AND CLOSING SAID CONTAINER

(75) Inventors: Nicoletta Razzaboni, Mirandola (IT); Vittorio Razzaboni, Mirandola (IT)

(73) Assignee: CIMA S.P.A. DI RAZZABONI & C., Mirandola (IT)

( * ) Notice: Subject to any disclaimer, the term of this patent is extended or adjusted under 35 U.S.C. 154(b) by 1596 days.

(21) Appl. No.: 12/452,007

(22) PCT Filed: Jun. 10, 2008

(86) PCT No.: PCT/EP2008/004621

§ 371 (c)(1), (2), (4) Date: Mar. 29, 2010

(87) PCT Pub. No.: WO2008/151773

PCT Pub. Date: Dec. 18, 2008

(65) Prior Publication Data

US 2010/0189379 A1 Jul. 29, 2010

(30) Foreign Application Priority Data

Jun. 12, 2007 (IT) ..... MI2007A1183
Nov. 14, 2007 (IT) ..... MI2007A2167

(51) Int. Cl.
*B65B 61/20* (2006.01)
*E05G 7/00* (2006.01)

(52) U.S. Cl.
CPC ..... *E05G 7/001* (2013.01)

(58) Field of Classification Search
USPC ..... 53/284.7, 397, 417, 476, 303, 304, 314, 53/317, 323, 324
See application file for complete search history.

(56) References Cited

U.S. PATENT DOCUMENTS 4,106,764 A * 8/1978 Tamura ..... 271/35
4,249,552 A * 2/1981 Margolin et al. ..... 194/207
4,866,254 A * 9/1989 Okayama et al. ..... 235/379
5,000,322 A * 3/1991 Goi ..... 209/534
6,553,744 B1 * 4/2003 Terminella et al. ..... 53/551

(Continued)

FOREIGN PATENT DOCUMENTS

GB 964 202 7/1964
GB 2 218 150 11/1989

(Continued)

OTHER PUBLICATIONS

International Search Report dated Sep. 25, 2008.

*Primary Examiner* — Sameh Tawfik
(74) *Attorney, Agent, or Firm* — Jacobson Holman, PLLC.

(57) ABSTRACT

A disposable container for valuable items that is suitable for being used in a machine for filling and closing the container, the container (16, 116) being suitable for being anchored to supporting elements (22, 23) of the machine so that a filling mouth (21, 121) of the container is positioned for receiving valuable items coming from the machine, such as banknotes, paper items (tickets, cheques, . . . ), coins, plastic chips for casinos, etc. With the edge of the mouth of the container there is associated coupling means (38, 39, 40, 41, 42, 45, 46, 138, 140, 142, 145) that is movable through the action of closing elements of the machine from a first decoupled position, wherein the mouth is open, to a second coupled position, wherein the mouth is closed, said coupling means being suitable for making an irreversible closure when it is taken to the second coupling position.

35 Claims, 13 Drawing Sheets

(56) References Cited

U.S. PATENT DOCUMENTS

| | | | | |
|---|---|---|---|---|
| 6,598,726 | B1 * | 7/2003 | Lundblad et al. | 194/206 |
| 7,003,931 | B2 * | 2/2006 | Gates et al. | 53/459 |
| 7,421,834 | B1 * | 9/2008 | Doolan | 53/570 |
| 7,461,747 | B2 * | 12/2008 | Razzaboni et al. | 209/534 |
| 2003/0000957 | A1 * | 1/2003 | Brexel et al. | 221/129 |
| 2005/0056519 | A1 * | 3/2005 | Yokoi et al. | 194/206 |
| 2006/0005564 | A1 * | 1/2006 | Metzger | 62/344 |
| 2008/0283145 | A1 * | 11/2008 | Maxwell | 141/114 |
| 2010/0032352 | A1 * | 2/2010 | Ozaki et al. | 209/534 |

FOREIGN PATENT DOCUMENTS

| | | |
|---|---|---|
| GB | 2 352 006 | 1/2001 |
| GB | 2 394 939 | 5/2004 |

* cited by examiner

DISPOSABLE CONTAINER FOR VALUABLE ITEMS AND MACHINE FOR FILLING AND CLOSING SAID CONTAINER

This is a national stage of PCT/EP08/004621 filed Jun. 10, 2008 and published in English, which has a priority of Italian no. MI2007A 001183 filed Jun. 12, 2007 and Italian no. MI2007A 002167 filed Nov. 14, 2007, hereby incorporated by reference.

BACKGROUND OF THE INVENTION

The present invention refers to an innovative disposable container for valuable items, of the type to be used in a machine for filling and closing the container.

The invention also relates to a machine for filling and closing disposable containers for valuable items, for example an automatic machine for managing banknotes.

BRIEF SUMMARY OF THE INVENTION

In the prior art, making disposable containers or bags to be used in automatic machine for filling and closing the containers is used. Machines of this type are used in supermarkets, shopping malls, banks or the like. In use, the bag is supported inside the machine, typically inside a safe, with the mouth maintained open in a position for receiving the banknotes from the machine. Once the bag has been filled, the machine closes the bag, by welding the flaps of the mouth of the bag. For this purpose, the machine has to be provided with suitable welding blades and with supporting and movement elements for supporting and moving the edge of the mouth of the bag. After closing, the bag can be removed from the machine for conveying the banknotes to another place.

The structure of the machine is very complex and costly, the members having to be present that are necessary for the closing welding of the container. Further, applying heat for welding entails a certain consumption of energy. Also, the closing operations may require a relatively long time.

The general object of the present invention is to overcome the drawbacks mentioned above by providing a disposable container for items and a machine for filling and closing the container that have a simple and cheap structure.

A further object of the invention is to provide a container for items that enables firm, secure and irreversible closure to be obtained so that an opening that is subsequent to the closing will be clear.

A further object of the invention is to provide a container for items and a machine that enable the irreversible closure to be achieved in a rapid manner without any need for considerable energy consumption.

A further object of the invention is to provide a filling and closing machine for filling and closing disposable containers that enables firm, secure and irreversible closure to be achieved so that an opening that is subsequent to closing will be clear.

Another object of the invention is to provide a machine for closing and filling the container that enables replacing of a full container with a new open container to be facilitated.

In view of this object it has been decided to make, according to the invention, a disposable container for valuable items that is suitable for being used in a machine for filling and closing the container, the container being suitable for being anchored to supporting elements of the machine so that a filling mouth of the container is positioned for receiving items coming from the machine, characterized in that on the edge of the mouth of the container there is associated coupling means that is movable through the action of closing elements for closing the machine from a first decoupled position, wherein the mouth is open, to a second coupled position, wherein the mouth is closed, said coupling means being suitable for achieving an irreversible closure of the container when the coupling means is taken to the second coupling position.

BRIEF DESCRIPTION OF THE DRAWINGS

In order to make clearer the explanation of the innovative principles of the present invention and the advantages thereof over the prior art, possible embodiments thereof will be disclosed below with the help of the attached drawings that apply such principles. In the drawings.

DETAILED DESCRIPTION OF THE INVENTION

Figure 1:
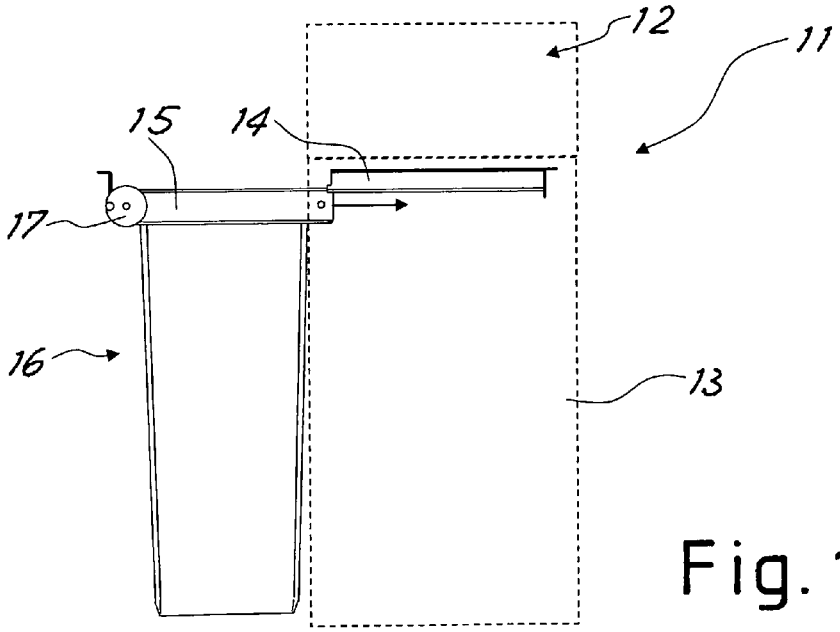
FIG. 1 shows a schematic view of a machine for filling and closing a disposable container configured for replacing the container.

With reference to the figures, in FIG. 1 there is shown a machine 11 for filling and closing disposable containers 16, for example an automatic machine for handling valuable items to be used in shopping malls, banks or the like.

The machine 11 comprises filling means 12 of valuable items (for example banknotes, paper items, tickets, cheques, coins, plastic chips for casinos, etc.) and a safe 13, intended for housing the container during the step of filling and closing the container. The filling means 12 and the safe 13 are shown schematically by a broken line and are per se made according to known techniques in the field of automatic machines for handling banknotes.

Figure 2:
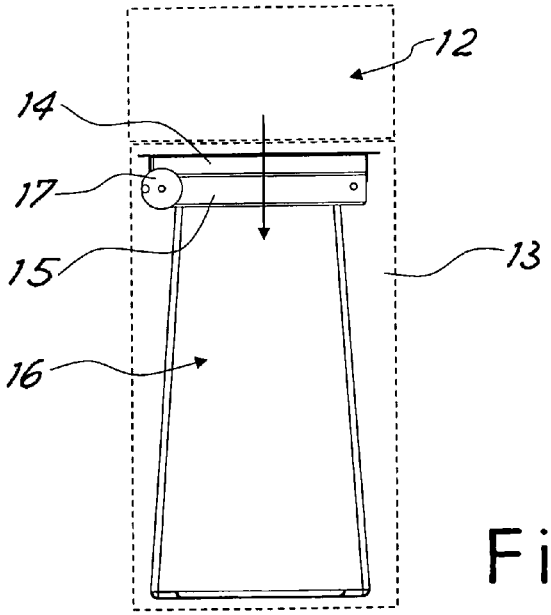
FIG. 2 shows a view similar to the preceding one in a configuration for filling and closing the container.

In FIG. 1 there is shown also a fixed frame 14 of the machine on which a cornice drawer 15 slide that is suitable for supporting the container 16 for the valuable items. The drawer 15 is slidable between an operating position inside the safe (FIG. 2) in which the container can be filled with a position outside the machine (FIG. 1) for replacing the full container with a new container to be filled. In FIG. 2 the vertical arrow indicates the conveying direction of the banknotes supplied by the means 12 for filling the container 16.

Figure 3:
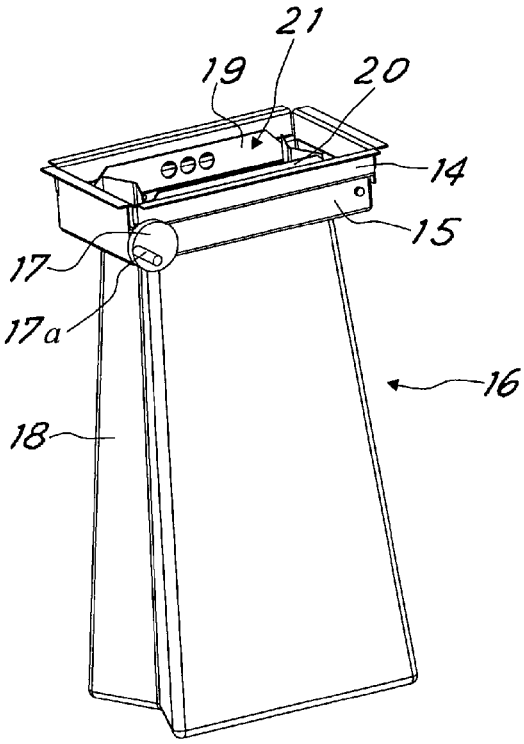
FIG. 3 shows a perspective view of the disposable container and of the supporting and closing means of the machine.

In FIG. 3 there is shown the container 16 supported by the drawer 15 in a retracted position with respect to the fixed frame 14, whilst the safe and the filling means are not shown for the sake of simplicity of representation.

The drawer 15 forms a cornice inside which the filling mouth 21 of the container remains positioned. The container 16 comprises a flexible wall portion 18 (or bag) for receiving the valuable items. At the mouth 21 the container is also provided with two stiff parts 19, 20 that bear coupling means intended for making an irreversible closure of the container, as will be shown below.

In FIG. 3 there is clearly shown a member 17 for manually activating the closing of the container in the form of a handwheel with a portion 17*a* to be taken by the user.

Figure 4:
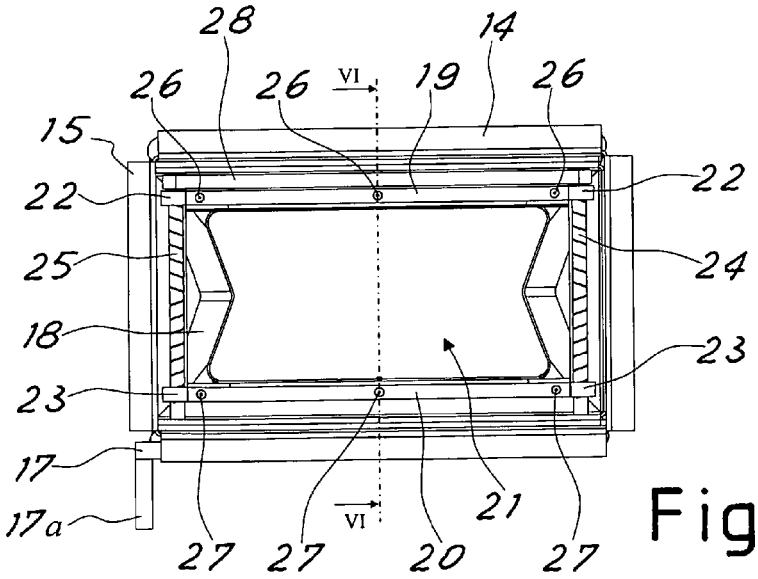
FIG. 4 shows a top view of the mouth of the container fitted on the supporting elements of the filling and closing machine.

In FIG. 4 there is shown a top view of the filling mouth 21 of the container. The stiff parts 19 and 20 have an elongated shape and are arranged facing on opposite sides of the mouth 21. The stiff parts 19, 20 are fixed to the upper edge of the flexible bag 18, as clearly shown also in FIG. 5.

On the drawer 15 there are mounted supporting elements for supporting the container 22, 23, provided with pivots 26 and 27 on which corresponding holes are fitted that are formed in the stiff parts 19, 20 of the container; in particular the part 20 has holes 33 on the horizontal flange 34 suitable for being fitted onto the pivots 27; the stiff part 19 has suitable holes on the horizontal flange 35, that are engageable on the pivots 26.

The supporting elements 22, 23 are connected to the cornice frame of the drawer 15 by two screws 24 and 25 and are coupled with a screw-nut coupling. The screws 24, 25 are mounted on the drawer 15 so as to be able to rotate. The drawer 15 has a rectangular shape and the screws 24, 25 are arranged at the short sides of the rectangle defined by the drawer, whilst the supporting elements 22, 23 have the shape of rods arranged along the long side of the rectangle. The pivots 26, 27 are three and are spaced regularly along the extent of the elements 22, 23 to ensure firm anchoring of the stiff parts 19, 20.

Each screw 24, 25 has two portions with threads facing in an opposite direction so that, by rotating the screws, the two rods 22, 23 are moved towards or away from one another.

The handwheel 17 can be used to rotate the screws, the handwheel 17 being, for example, connected by a suitable gear to the screw 25. The handwheel enables the rods 22, 23 to be activated manually to close the mouth 21 of the container. Nevertheless, it should be noted that there could also be a motor present for controlling the movement of the rods 22, 23 in an automatic manner.

The stiff parts 19, 20 are formed of a piece of plastics with a substantially flattened shape; the upper portion of the two parts 19, 20 respectively has holes 31 and 32 to facilitate taking the container by hand outside the machine or replacing the container. The lower portions 36 and 37 of the stiff parts 19, 20 are fixed to the flexible wall of the bag 18 and bear the irreversible coupling means. As clearly shown in FIGS. 6 and 7, portions 36 and 37 are placed against the supporting elements 22 and 23, so that the coupling means 42, 43 are pressed against one another when the two rods 22, 23 are moved towards one another during the container closure step.

With the mouth of the container there is associated coupling means such as to achieve an irreversible closure of the container, the coupling means being made so as to break in the event of opening of the container following the first closure. Breaking the coupling means makes the attempt to open the bag obvious.

Advantageously, the coupling means is of mechanical type, and comprises at least a male element protruding from the stiff part 20 that is suitable for engaging in a corresponding female seat formed on the other stiff part 19.

Figure 8:
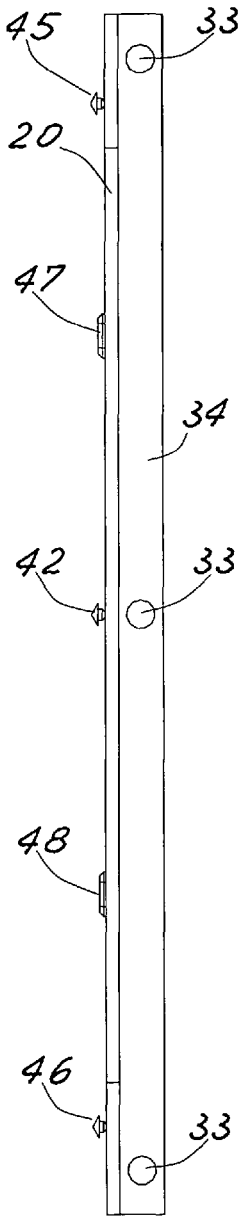
FIG. 8 shows an enlargement of a stiff part of the disposable container bearing the coupling means for closing the container.

FIG. 8 shows that the stiff part 20 has three male coupling elements 42, 45 and 46, at the anchoring holes 33 on the supporting element 23 of the filling machine, or in a central position and at the ends of the body 20; the three pivots 42, 45 and 46 are suitable for engaging in the corresponding seats 38, 40 and 41 on the stiff part 19. Further, there are protrusions 47 and 48 on the body 20 intended for engaging in the seats 39 on the stiff part 19.

The body 19 can also comprise a pair of longitudinal ribs 43, arranged above and below the seats 38-41, suitable for engaging in the channels 44 of the body 20 to prevent the banknotes being taken with the bag closed.

Figure 9:
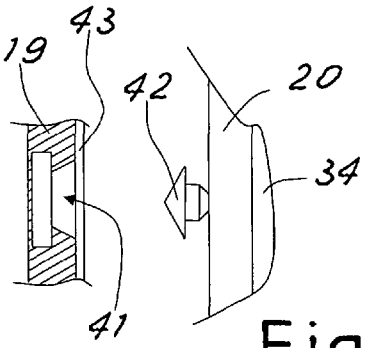
FIG. 9 shows an enlargement of the coupling means of the container of the preceding figures.

As clearly shown in the enlargement in FIG. 9, the male element 42 comprises a head portion suitable for engaging by clicking irreversibly in the seat 41. On the base of the male part 42, at the attachment point on the wall of the stiff part 20, the section of the pivot is thinned. If the container is opened following the irreversible closure, the pivot 42 breaks at the thin point, as a clear sign that the container has been opened.

Figure 5:
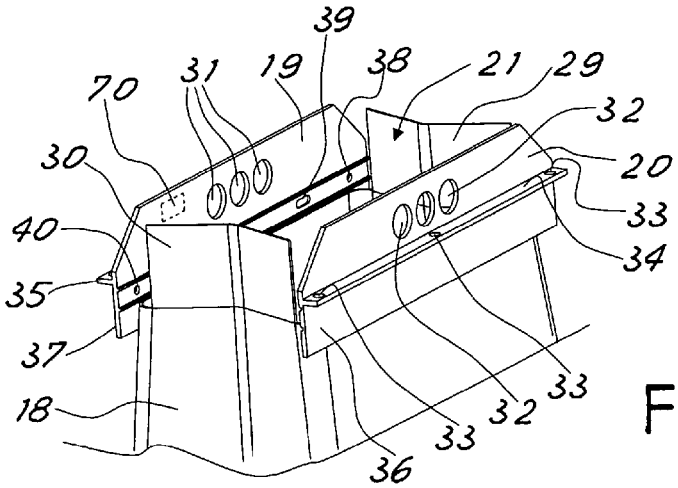
FIG. 5 shows a detailed view of the filling mouth of the disposable container of the preceding figures.

At the mouth of the container 16 two corner panels 29 and 30 are preferably provided that are applied to the flexible wall of the bag interposed between the two stiff parts 19, 20 of the container on opposite sides (see FIG. 5). The two panels are semi stiff and are foldable along the median longitudinal line so that the side portions of the bag 18 remain interposed between the stiff parts 19, 20 and effective closing of the container is assured. The panels 29, 30 may also have the function of ensuring correct conveying of the banknotes inside the container.

Figure 6:
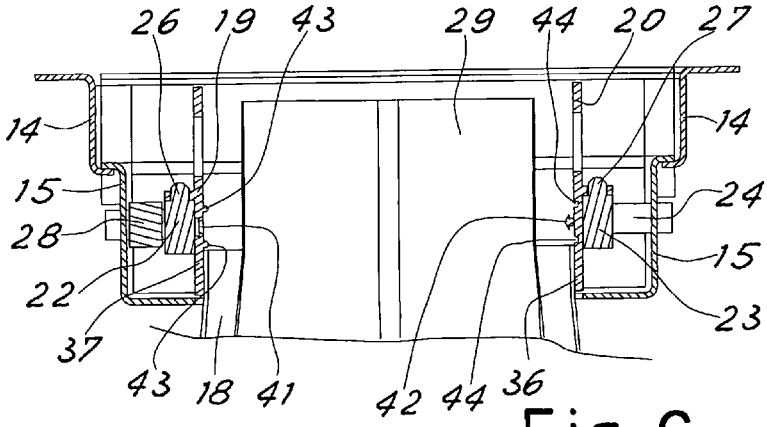
FIG. 6 shows a section view according to the plane VI-VI indicated in FIG. 4.
Figure 7:
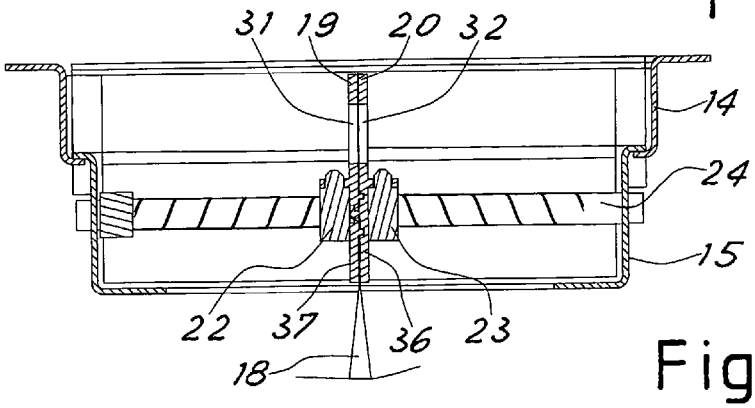
FIG. 7 shows a section view that is similar to the preceding view with the mouth of the container closed.

In FIGS. 6 and 7 there are shown the two configurations of the container in the machine 11, respectively with the mouth open and the mouth closed in an irreversible manner.

By rotating the screws 24, 25 in the appropriate direction the two supports 22, 23 move together and move from the position in FIG. 6 to that in FIG. 7, in which the coupling means 42, 45, 46 and 38, 40 and 41 are mutually coupled, thus firmly closing the container.

It should be noted that the irreversible closure coupling could also occur by means of a suitable chemical substance, for example glue or a solvent, associated with the coupling means so as to enter into action when the coupling means is taken to the closure position.

The chemical agent could also be a solvent glue that is such as to melt the plastics that form the male and the female of the coupling so as to generate an irreversible coupling. The glue could be housed inside the seat 41 contained in a suitable membrane and be released so as to hit the pivot 42 when the latter enters the seat.

In FIG. 5 there is also shown a transponder 70, which is advantageously made integrated into the stiff part 19 of the container. The transponder enables the information relating to the bag and the contents of the bag to be written and read, enabling optimal management of the logistics of the bag and monitoring of the movements. It is impossible to remove the transponder without inhibiting the operation thereof and any replacement is detected by the system of the machine that does not recognize the transponder as original and can inhibit the operation thereof. The transponder could also be inserted into the flexible part of the bag immediately below the two stiff parts rather than in the stiff part.

The supporting frame 14 is electrified with low voltage to manager sensors monitoring for the presence of the bag and for the operation of the transponder, in addition to activating the actuators to close the bag automatically, if there are actuators.

The container-supporting frame assembly of the machine can be designed so as to prevent any access to the contents of the container even with the safe 13 open. For this purpose, locking means can be provided for locking the sliding of the movable frame 15 that is movable away from the frame 14 that prevents the exit of the drawer when the container has not yet been closed. The locking means can be controlled advantageously by automatic control means of the filling and closing machine 11.

The drawer 15, if necessary, can be movable on telescopic guides to be taken to the position for replacing the bag shown in FIG. 1.

The container 16 can be provided with known banknote-staining means for antitheft purposes. The bag can be advantageously made with a transparent wall to enable the contents to be inspected visually. The wall of the bag can further be made of a perforated material to ensure staining of the banknotes.

The capacity of the single-chamber container may also be greater than 5000 banknotes.

Figure 10:
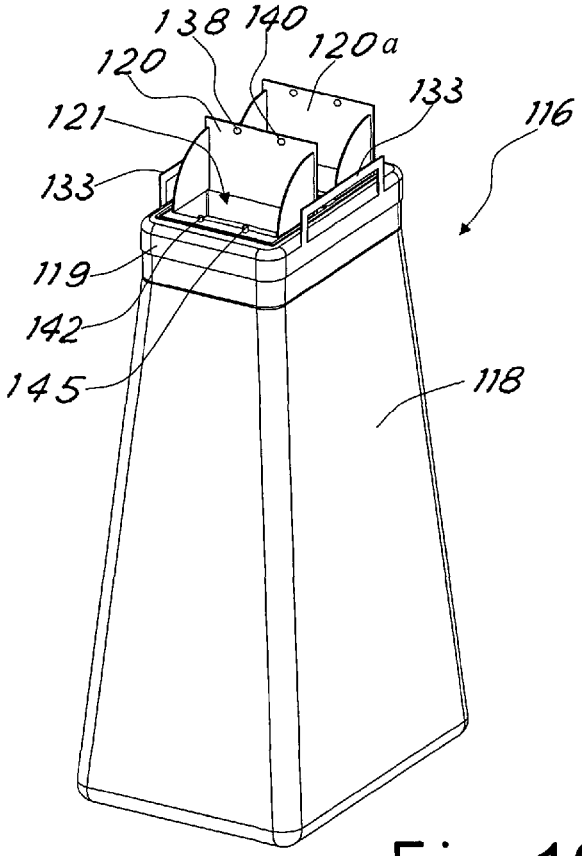
FIG. 10 shows a perspective view of a second embodiment of the disposable container according to the invention.
Figure 11:
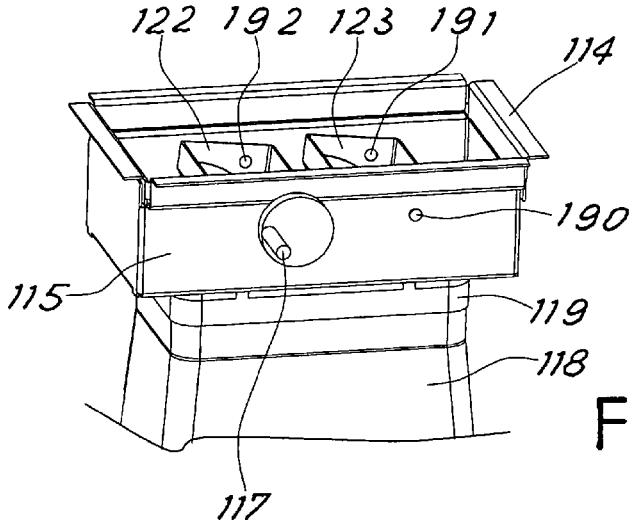
FIG. 11 shows a perspective view of the filling mouth of the container in FIG. 10 fitted on the supporting elements of the filling and closing machine.
Figure 12:
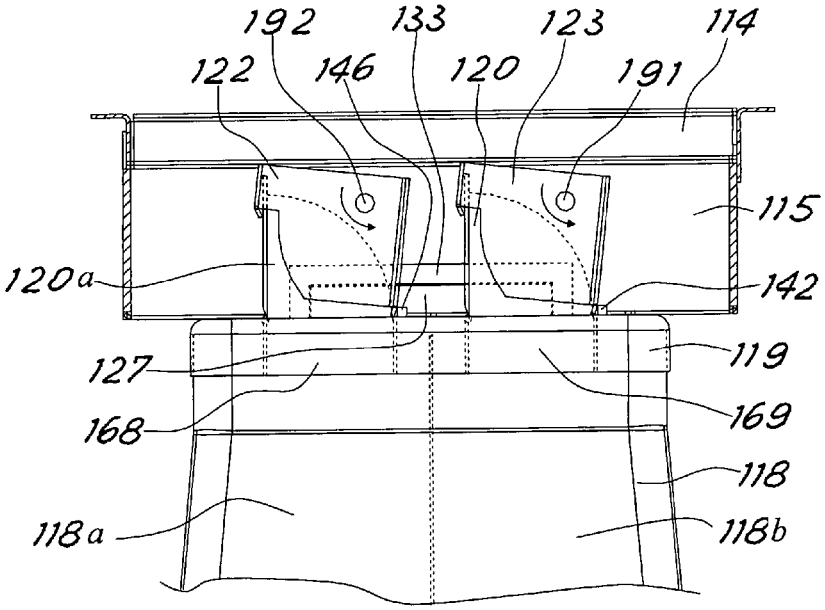
FIG. 12 shows a raised view of the filling mouth of the container fitted on the machine, with a part of the frame of the machine removed to enable the machine closing elements to be viewed.

In FIGS. 10 to 12 there is shown a version of the invention, where only the supporting and closing elements of the machine are shown in addition to the disposable container, omitting to show the filling means and the safe of the machine, which are per se made according to the prior art. FIG. 10 shows a disposable container 116 provided with two internal chambers, so as to have the possibility of storing the valuable items in an orderly, separated and above all selective manner.

The container 116 comprises a flexible portion 118 for receiving the valuable items and a stiff cornice 119 to which the upper edge of the bag 118 is fixed. The stiff cornice 119 comprises means 133 for anchoring to suitable supports of the machine, in the form of two small rods suitable for hooking onto the protrusions 127 that are integral with the slidable frame 115 of the machine (see FIG. 12).

On the cornice 119 two doors 120 and 120*a* are hinged that are suitable for closing the mouths of the two internal chambers of the container; in FIG. 10 a filling mouth of one of the chambers of the container is indicated by 121.

In the cornice 119 there are two openings 168 and 169 through which the banknotes can enter the two internal chambers 118*a* and 118*b*, separated by a baffle inside the bag 118 (FIG. 12).

Coupling means for achieving an irreversible closure of the container is associated with the doors 120, 120*a* and the cornice 119.

The coupling means comprises a pair of pivots 142 and 145 protruding from the cornice 119 suitable for engaging in corresponding holes 138, 140 of the door 120; a further pair of coupling pivots is provided for the door 120*a*. Coupling may occur in a manner that is similar to what has already been disclosed for the coupling means 41, 42 disclosed previously, possibly also with the presence of a chemical substance that is suitable for encouraging the firm and irreversible closure of the container.

In FIGS. 11 and 12 there is also shown part of the closing and filling machine for closing and filling the container, which comprises a fixed frame 114 on which the drawer 115 slides, which a forms a movable cornice frame; the drawer 115 bears the supporting means for supporting the container 127 that is suitable for cooperating with the rods 133 of the container for supporting the container is in position during the filling and closing operations.

In the figure the drawer is shown in the retracted position in the machine.

The drawer bears movable closing elements 122 and 123 that are suitable for acting on the doors 120 and 120*a* to cause the irreversible coupling of the means 138, 140, 142 and 145. The movable elements 122, 123 also form two feeding channels for feeding valuable items into the respective internal chambers of the container and are pivoted on the internal faces of the drawer 115 with horizontal-axis 190-192 pivoting; rotating the elements 122 and 123 in the direction of the arrows indicated in FIG. 12, the doors 120, 120*a* are pushed closed on the cornice 119 until the irreversible coupling of the pivots in the respective seats is achieved. The elements 122 and 123 can be rotated manually by the handwheel 117, connected by suitable kinematic motion to the movable elements. It is understood that a motor could be present for the automatic activation of the rotation of the two closing elements.

Figure 13:
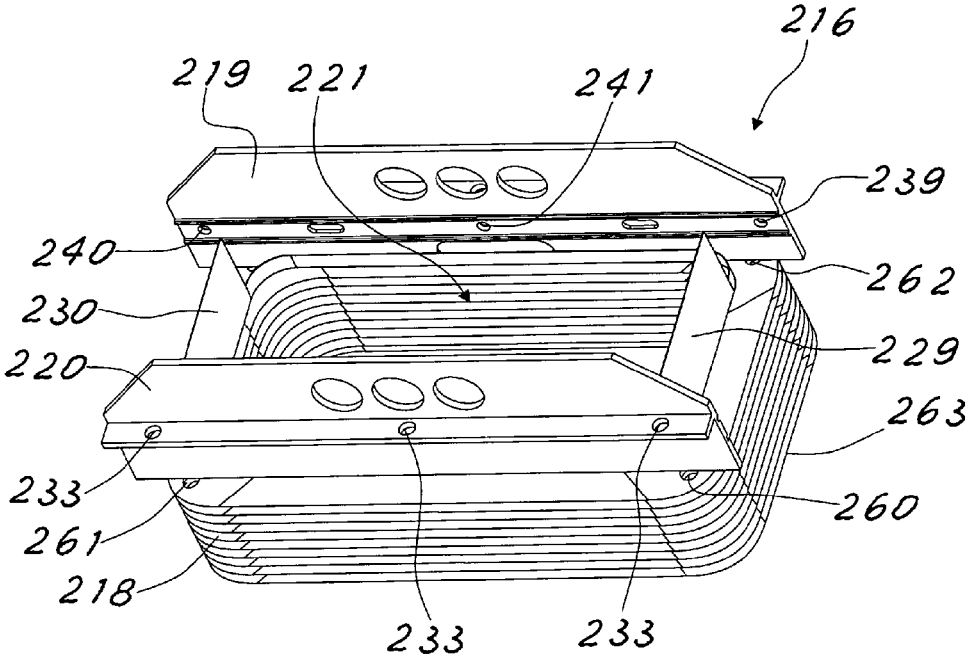
FIG. 13 shows a third embodiment of a container according to the invention.

In FIG. 13 there is shown a third embodiment of a disposable container according to the invention, that is similar to the first embodiment but with a different type of bag 218. The reference numbers in FIG. 13 are increased by 200 compared with the numbers that refer to corresponding elements of the first embodiment.

The bag 218 is formed of two concertina side walls that are able to expand in a vertical direction. The bag has a parallelpipedon shape that forces the banknotes to pile up on one another. The expansion of the bag varies the capacity of the container to receive the banknotes gradually, maintaining the drop distance uniform so as to be able to control better the position of the valuable items.

Once maximum capacity has been reached, the container is closed irreversibly in the manner disclosed previously for the first embodiment. At the vertical corners of the bag there are aligned holes 260, 261, 262, in which corresponding guiding rods of the machine are inserted to control the expansion of the concertina parts. On the bottom 263 of the bag there can be provided a stiff panel that can be moved to command a desired expansion of the container by actuating means of the machine associated with the bottom of the bag.

It remains understood that the closing and filling machine can be provided with known automatic control means that commands in a coordinated manner the conveying of the banknote, the automatic closure of the bag if there is motor means present for moving the elements for closing the machine, and any other operation that can normally be required of the machine.

Figure 14:
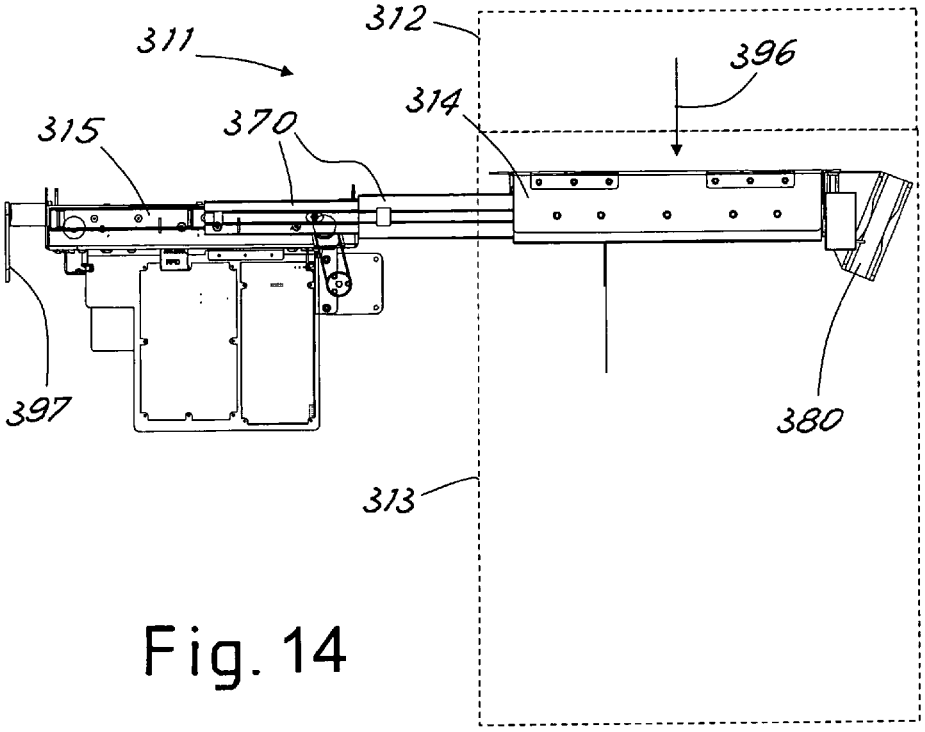
FIG. 14 shows a schematic view of an alternative embodiment of a machine for filling and closing a disposable container with the drawer extracted for replacing the container.

In FIG. 14 there is shown a further embodiment of a machine 311 for filling and closing disposable containers, for example an automatic machine for managing valuable items to be used in shopping malls, banks or the like.

The machine 311 comprises filling means 312 for filling with valuable items (for example banknotes, paper valuable items, tickets, cheques, coins, plastic chips for casinos, etc.) and a safe 313, which is intended for housing the container during the step of filling and closing the container. The filling means 312 and the safe 313 are shown schematically by a broken line and are per se made according to techniques that are known in the field of automatic machines for handling banknotes.

Figure 15:
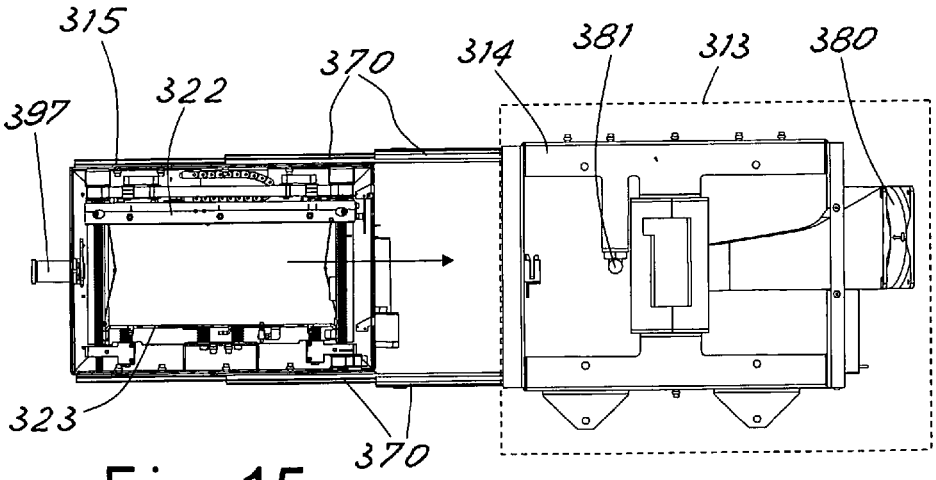
FIG. 15 shows a top view of the machine in FIG. 14.

In FIG. 14 there is also shown a fixed frame 314 of the machine on which a cornice drawer 315 can advantageously slide by means of telescopic guides 370, the cornice drawer 315 being suitable for supporting the container for the valuable items. The drawer 315 is slidable between an operating position inside the safe (not shown) in which the container can be filled and a position outside the safe 313 (FIG. 14) for replacing the full container with a new container to be filled. In FIG. 15 an arrow shows the movement direction of the drawer 315 to the inside of the safe 313, which can be moved manually by acting on the handle 397; in FIG. 14 the arrow 396 indicates the conveying direction of the banknotes when the container is inside the safe 313.

Figure 17:
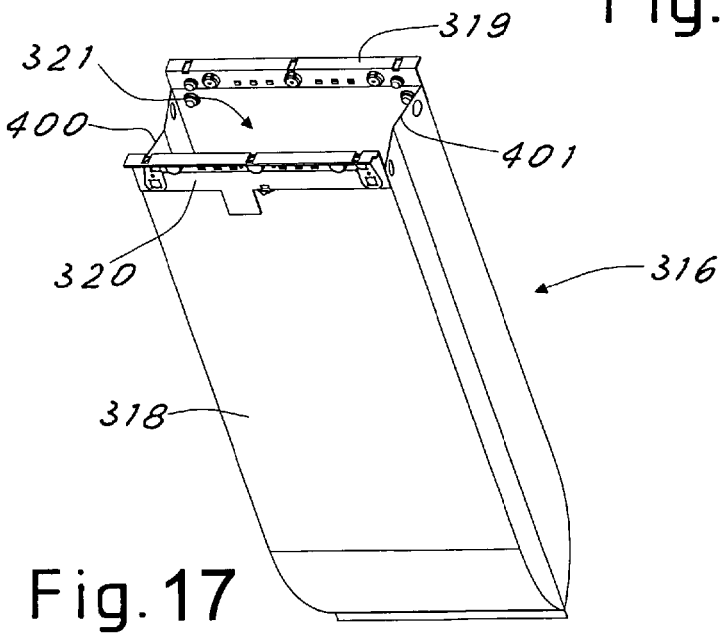
FIG. 17 shows a perspective view of a disposable container to be used in the machine according to FIG. 14.

The drawer 315 forms a frame inside which the filling mouth 321 of the container 316 remains positioned in use. The container 316 comprises a flexible wall portion 318 (or bag) for receiving the valuable items (FIG. 17). At the mouth 321 the container is also provided with two stiff parts 319, 320 that bear coupling means intended for making an irreversible closure of the container, as will be shown below.

The stiff parts 319 and 320 have an elongated shape and are arranged facing on opposite sides of the mouth 321. The stiff parts 319, 320 are fixed on the upper edge of the flexible bag 318, and between stiff parts 319, 320 there remain two free edge portions 400, 401 of the mouth of the bag 318.

On the drawer 315 there are mounted supporting elements of the container 322, 323, there are provided fixtures 326 and 327 on which corresponding openings 333, 334 engage that are formed respectively in the stiff parts 319, 320 of the container; the openings 333, 334, for example three per side, are formed on horizontal flanges of the stiff parts 319, 320.

The supporting element 322 is connected to the cornice frame of the drawer 315 by two screws 324 and 325 with a screw-nut coupling. The screws 324, 325 are mounted on the drawer 315 so as to be able to rotate, advantageously through the action of suitable belt-drive means 385, mounted on the drawer.

The drawer 315 has a rectangular shape and the screws 324, 325 are arranged at the short sides of the rectangle defined by the drawer, whilst the supporting elements 322, 323 have the shape of rods arranged along the long side of the rectangle. There are three pivots 326 and they are spaced regularly along the extent of the element 322 to ensure firm anchoring of the stiff part 319. The supporting element 323 is substantially integral with the cornice 315 and is pushed to the opposite element 322 by means of the springs 382.

The stiff parts 319, 320 of the container have a substantially flattened shape.

With the mouth 321 of the container there is associated coupling means so as to make an irreversible closure of the container, the coupling means being made so as to break in the event of opening of the container following the first closure. The breakage of the coupling means makes the attempt to open the bag obvious.

Advantageously, the coupling means can be of a purely mechanical male/female type 342, 345 and 347, or also comprise seats 344 provided with glue caps that are suitable for receiving a corresponding head 343 of the other stiff side of the container to perform sealing by gluing.

Advantageously, the side parts of the flexible bag may comprise holes 346 for promoting the use of the male parts 342 in the female parts 345 arranged at the height of the flexible wall of the container.

The machine 311 also comprises means 383 for pushing the side parts 400, 401 of the mouth 321 of the bag inside, so as to ensure that during the sealing of the container the side parts 400, 401 remain interposed between the stiff parts 319, 320 that are coupled together. This enables a high level of security to be obtained, thus certainly preventing the contents of the bag being accessible after sealing.

Figure 16:
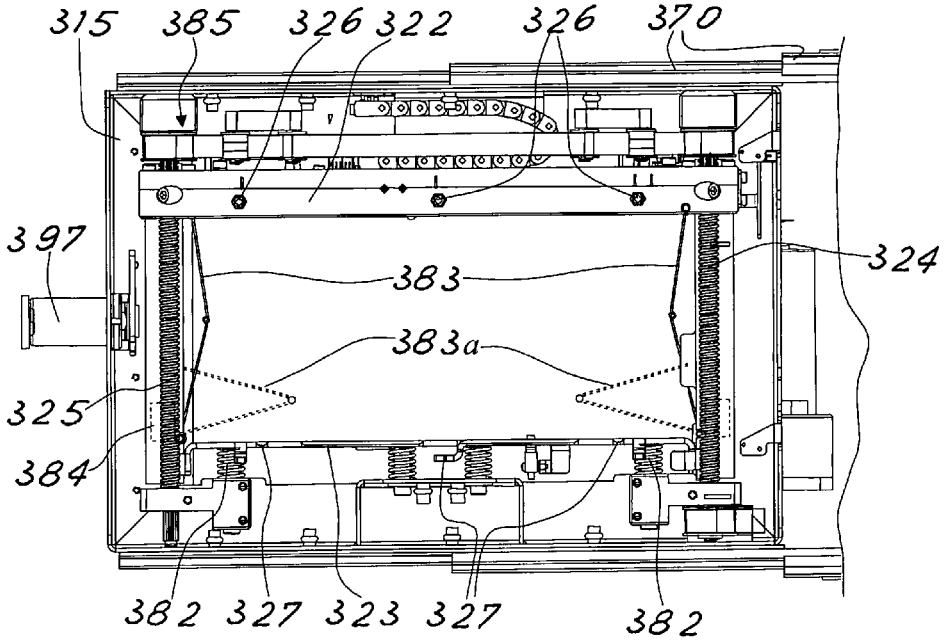
FIG. 16 shows an enlargement of part of the view in FIG. 15.
Figure 18:
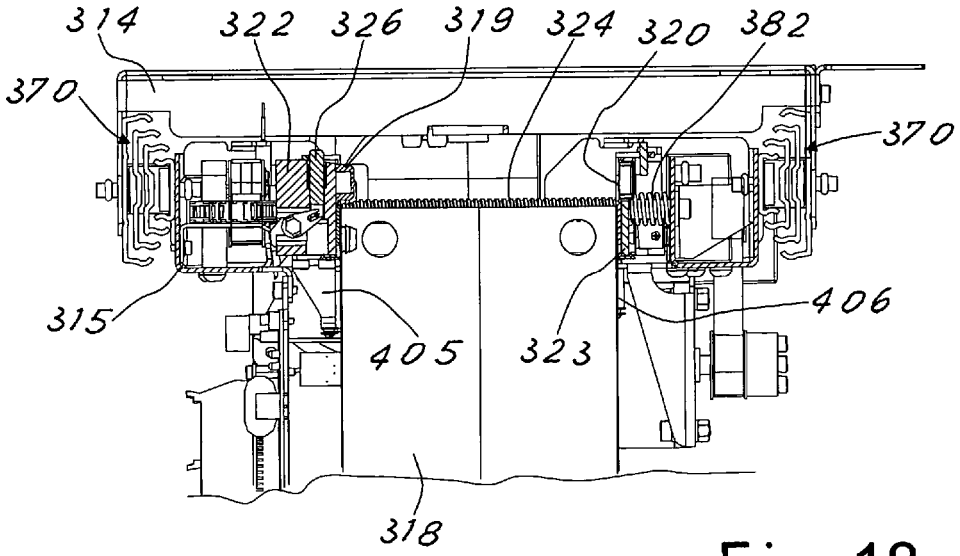
FIG. 18 shows a section view of the machine in FIG. 14 in which the container is applied in the filling position.
Figure 19:
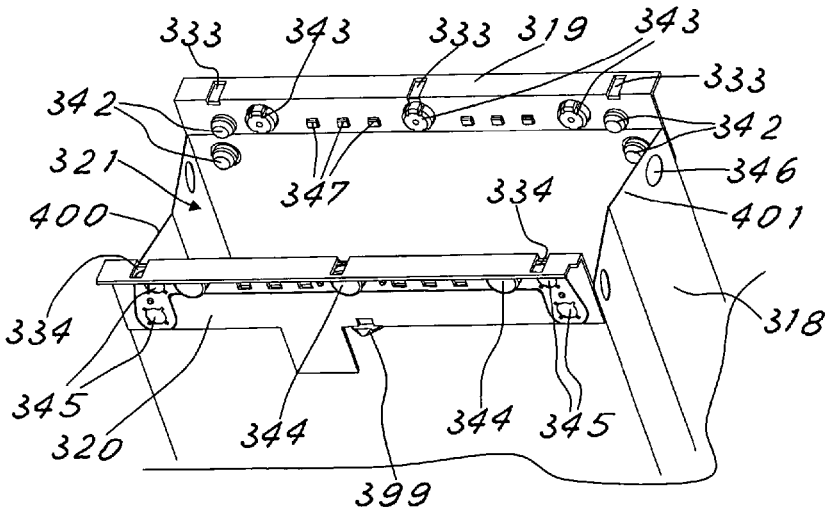
FIG. 19 shows an enlargement of the image in FIG. 17, showing the coupling means at the mouth of the container.

In FIG. 16 there is shown the means 383 in the shape of a compass element with the possibility of corner folding in a median position, connected at the ends to the supporting elements 322, 323. On the two opposite sides of the container 316 there is provided a respective element 383. When the supports 322, 323 are moved towards one another, the element 383 is folded so as to form an acute angle, as indicated by 383*a* with a broken line in FIG. 16. Advantageously the two elements 383 are made with compass springs, anchored below to the supports 405, 406 protruding respectively from the supporting elements 322 and 323 (FIG. 18).

It remains understood that also other mechanisms can be provided, which can be automatically activated so as to push edge portions 400, 401 inside the bag when the stiff parts 319, 320 are moved together for closing. A dedicated electric drive can possibly be used to push the flaps 400, 401.

The vertical pivots 326 on which the corresponding anchoring openings 333 are fitted that are formed on the stiff part 319 of the container are slidable vertically with respect to the supporting element 322 between a position in which they protrude to engage in said anchoring openings 333 and a retracted position to free the container 316 from the engagement.

Advantageously, the vertical pivots 326 are moved between the retracted position and the protruding position by means of an automatic mechanism 390, 392, 384 suitable for commanding the retraction of the pivots when the closing elements 322, 323 of the machine are moved near to achieve the irreversible closure of the container 316.

In particular, the mechanism for retracting the pivots 326 comprises a shaft 392 on to which a lever 390 is fixed that is suitable for acting on a pin 391 protruding from the lateral surface of the pivot 326, so that by rotating the shaft 392 the pivot 326 is respectively raised or lowered. It remains understood that a lever 390 can be provided for each pivot 326. The shaft 392, advantageously, can be engaged with suitable fixed abutments 384, indicated by broken lines schematically in FIG. 16, which are integral with the drawer 315 near the supporting element 323 along the sliding path of the supporting element 322. Such fixed abutments 384, which are suitable for rotating the shaft 392, can be made in a various ways, for example with a rack or in other forms that are easily imaginable by those skilled in the art.

Figure 20:
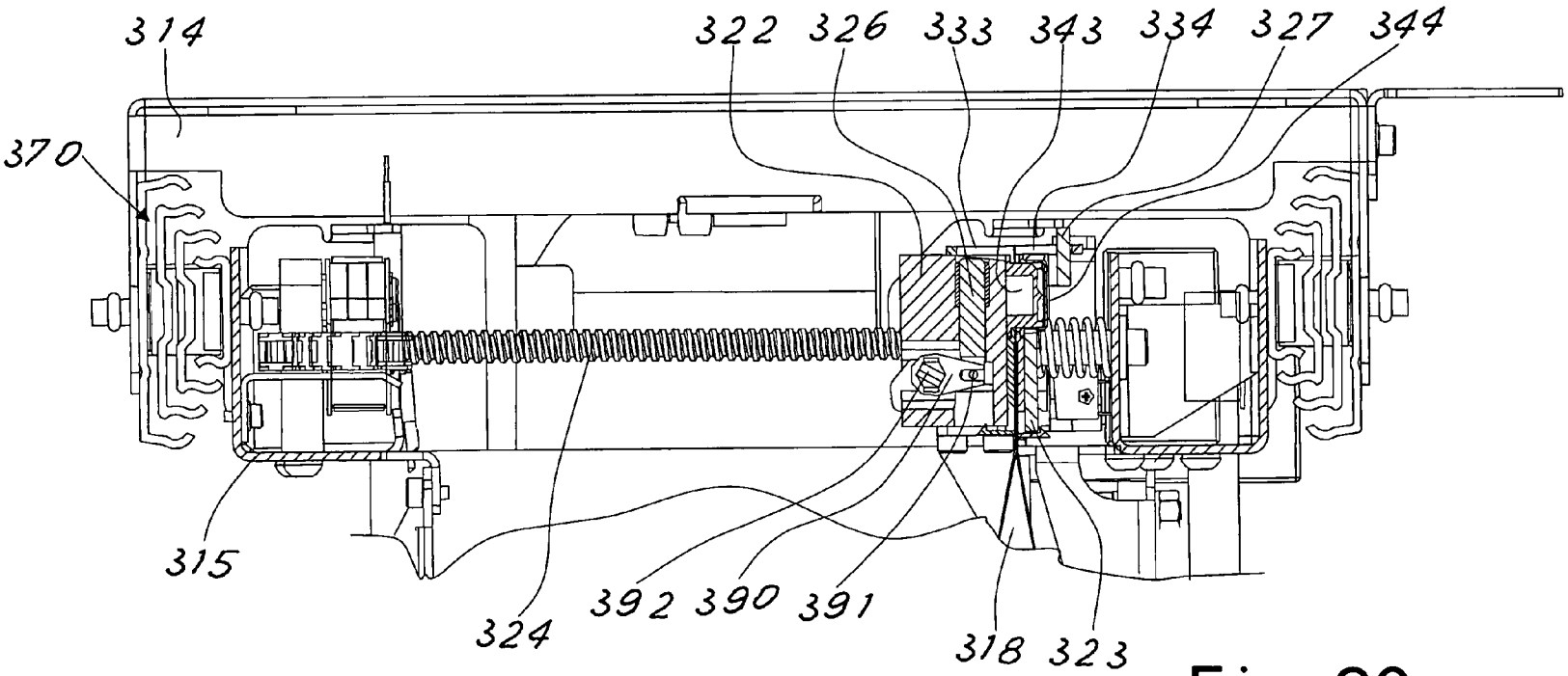
FIG. 20 shows a similar section view to that in FIG. 18, during closing of the container.
Figure 21:
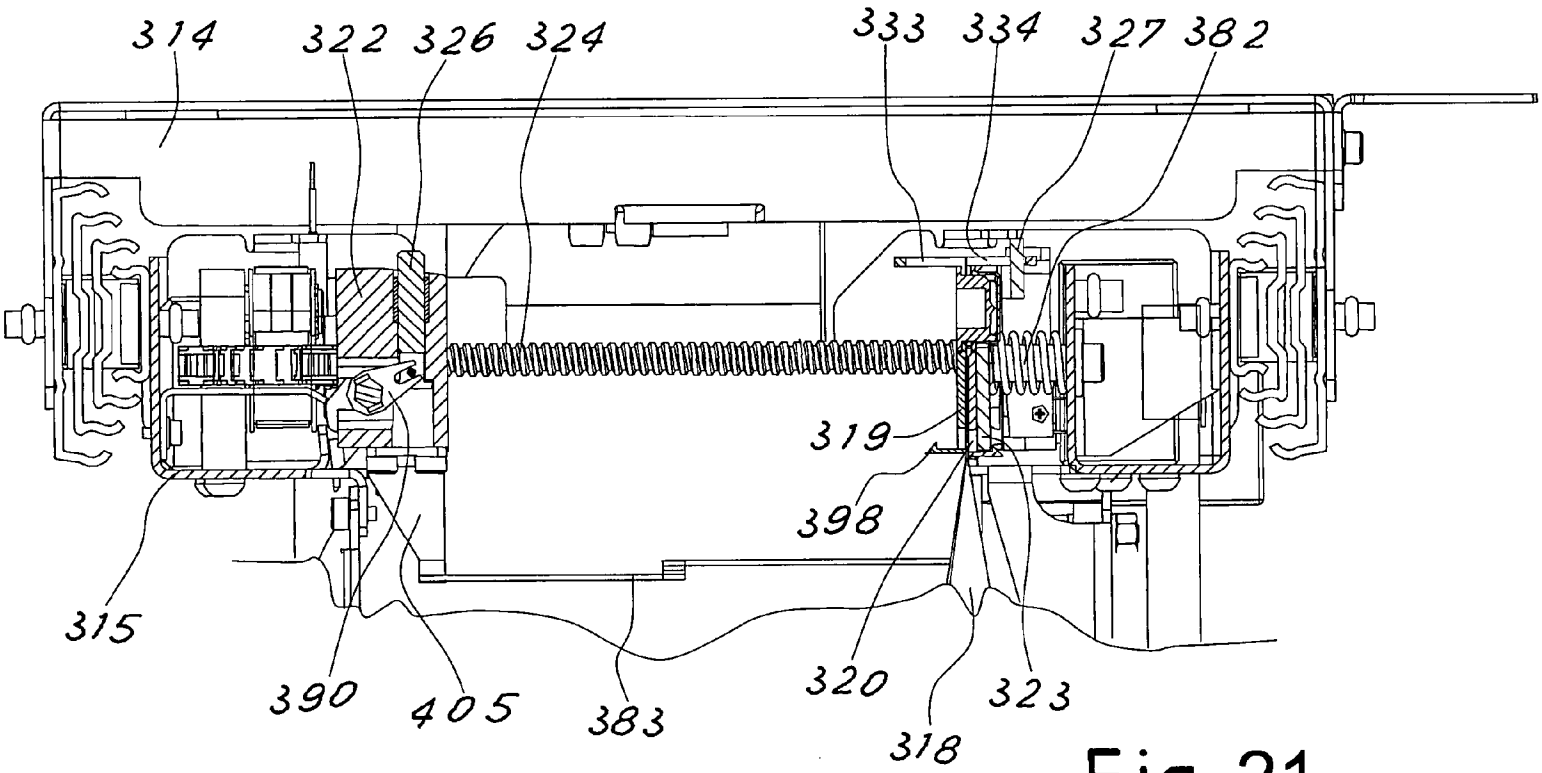
FIG. 21 shows a section view similar to that in FIG. 20, configured for facilitating the extraction of the container from the machine.

In FIGS. 18, 20 and 21 three different configurations of the container 316 applied to the machine 311 are shown, respectively with mouth open, mouth closed in an irreversible manner and with mouth closed ready for being removed from the machine.

At the end of the container filling step, by rotating the screws 324, 325 in the appropriate direction, the support 322 moves towards the support 323 moving from the position in FIG. 18 to that in FIG. 20, in which the reciprocal coupling means of the parts 319, 320 engage mutually, achieving the firm closure of the container. In particular, as shown in the section, the head 343 of the part 319 is inserted into the seat 344 of the stiff part 320 that contains a glue cap, which achieves a sealing closure of the container.

As clearly shown in FIG. 20, the lever 390 is rotated downwards when the support 322 is in the bag closure position, with the result that the pivots 326 disengage from the stiff part 319 of the container, retracting inside the support 322.

After the bag has been sealed, by reversing rotation of the screws 324, 325, the support 322 is returned to the initial position, as shown in FIG. 21, facilitating the replacement of the filled container with a new empty container. The container that has just been filled in fact remains anchored only to one side at the fixtures 327 on the support 323, and is easily removable from the machine.

The machine 311 can possibly be provided with a fan 380 and a suitable conduit to provide ionized air to the container, so as to prepare the container for receiving the banknotes and to neutralize the electrostatic charges that form on the banknotes during conveying in the machine. For this purpose, there is provided a suitable ionizing device that is suitable for generating ions just upstream or downstream of the fan 380.

Further a direct probe sensor 381 can be provided for monitoring the level of banknotes inside the bag.

Each stiff part 319, 320 of the container can be provided with two molded objects of different materials that are coupled together, one for forming the support fixed to the flexible bag and the other for forming the mechanical joints for irreversible coupling and sealing gluing of the container.

Advantageously, each stiff part 319, 320 of the container can comprise a hook 398, 399 for promoting firm anchoring on the respective supports of the machine.

It remains understood that the closing and filling machine can be provided with known automatic control means that commands in a coordinated manner conveying of the banknote, the automatic closure of the bag and any other operation that may normally be required of the machine.

Figure 22:
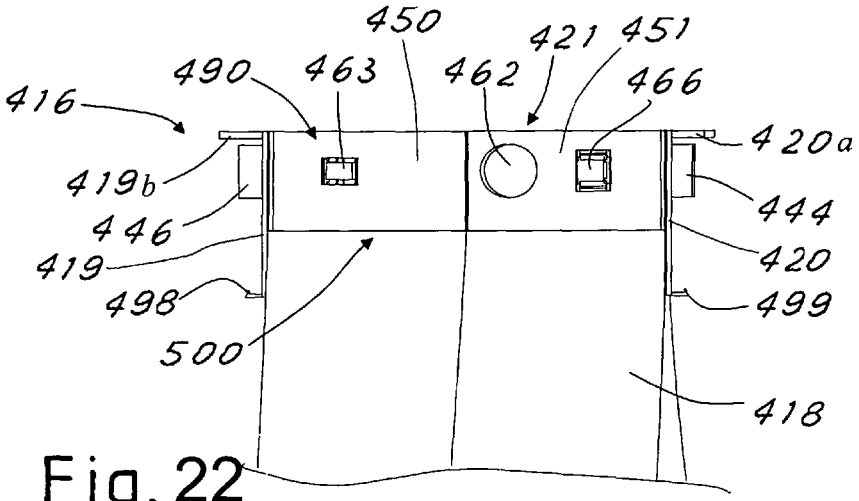
FIG. 22 shows a partial view of a further alternative embodiment of a disposable container for valuable items in an opening condition.
Figure 23:
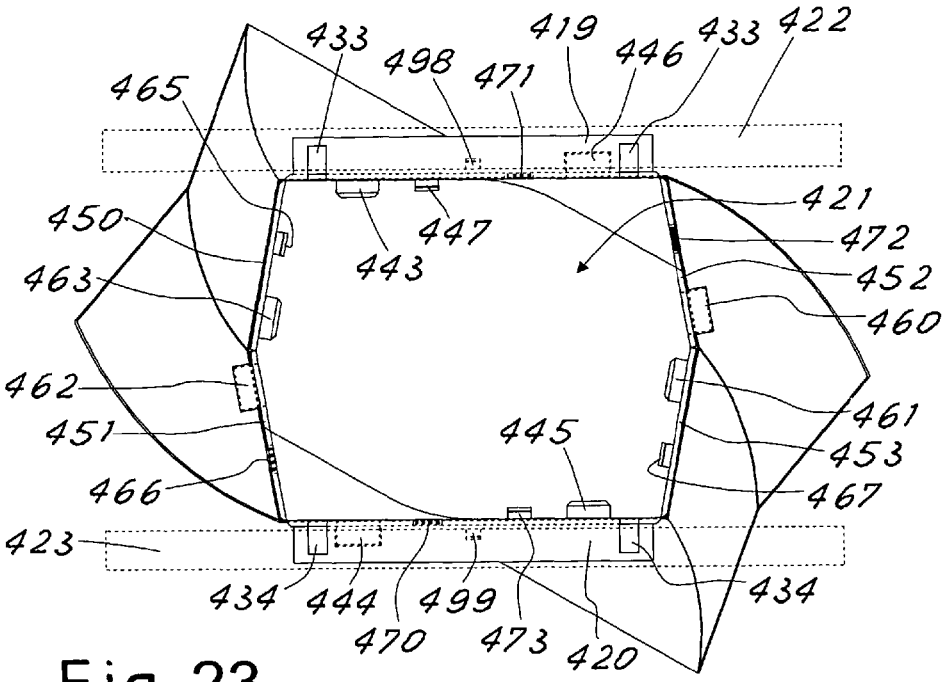
FIG. 23 shows a top view of the container in FIG. 22 in an open condition.
Figure 24:
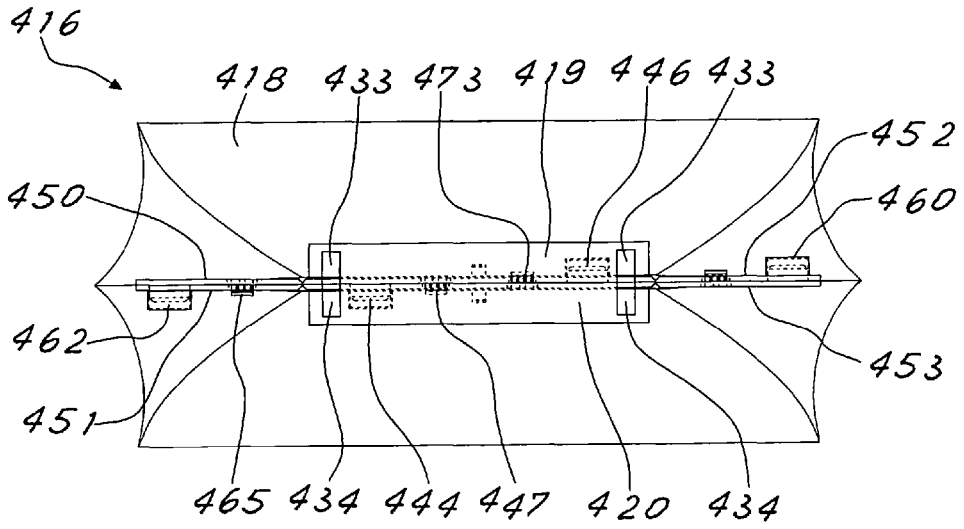
FIG. 24 shows a top view of the container in FIG. 23 in the condition of irreversible closure.

In FIGS. 22-24 there is shown a further alternative embodiment of a disposable container 416 for valuable items to be used in an automatic machine for filling and closing the container.

The container 416 comprises a flexible wall portion 418 intended for receiving the valuable items during the step of filling through the upper mouth 421, indicated in FIG. 23. The part 418 is provided above with an opening, whose edge 500 is fixed, almost along the entire perimeter, to a cornice 490 of the container 416, which bears the coupling means to achieve the irreversible closure of the container.

The cornice 490 has means 433, 434 for being anchored on corresponding supports 422, 423 of the filling and closing machine (shown as a broken line in FIG. 23), so that the container 416 can be held in the correct position during filling and be moved in an automatic manner to the closure position after the container has been filled.

The cornice 490 is made flexible to be movable between an open position (FIG. 23) for filling with banknotes and a closure position (FIG. 24) in which the coupling means are irreversibly coupled together.

Advantageously, the coupling means may be of a chemical nature (and include, for example, glues, enclosed in suitable caps) and/or simply be of a mechanical nature, with irreversible mechanical joints.

Preferably, the cornice 490 is formed by a ring element that is locally flexible in a plurality of points to enable the passage from the open to the closed position. In particular, the cornice 490 in the open position has a polygonal shape, when viewed from a top view, with a plurality of segments 419, 420, 450, 451, 452 and 453. The structure with a polygonal frame, preferably made of plastics, has flexure points at the apices of the polygon and is on the other hand substantially stiff at the segments.

As shown in FIG. 23, advantageously, the cornice 490 in the open position has a hexagonal shape. Each segment 419, 420, 450, 451, 452 and 453 of the cornice 490 has coupling means coupled with another corresponding segment of the cornice. The cornice has a substantially rectilinear shape (FIG. 24) in the closed position.

The segments of the cornice 490 have a flat shape. The segments 419 and 420, opposite one another, have respective horizontal flanges 419*a*, 420*a* that have suitable openings 433, 434 respectively for anchoring to corresponding fixtures of the supporting elements of the machine for the automatic filling and closing of the container (which is not shown). Preferably, each segment 419, 420 has a pair of openings 433, 434 at the opposite ends thereof.

The segment 419 has a head 443 that is suitable for being coupled irreversibly in the cavity 444 of the segment 420, in which there is provided a glue cap. The segment 419 also has a mechanical irreversible coupling element 447, intended for engaging in the opening 470 in the segment 420. The segment 420 has in turn a head 445 intended for engaging in the cavity provided with glue 446 formed in the segment 419.

The segment 450 has coupling means 463, 465 intended for engaging in corresponding cavities 462, 466 of the segment 451. Similarly, the segment 453 has coupling means 461, 467 intended for coupling in the cavity 460, 472 of the segment 452.

The side segments 450-453 do not bear connecting means for connecting to supporting elements of the machine and are connected in sequence between the two segments 419, 420.

The segments 419, 420 also comprise respective lower hooks 498, 499 for firmer anchoring to the supporting parts of the machine.

Naturally, the supporting elements 422, 423 of the machine will have a greater length than the segments 419, 420 to be able to press together also the side segments 450-453 during the closing step and promote coupling of the coupling means arranged on the side segments.

This particular configuration of the container 416 enables firm and secure closure to be obtained also without requiring particular machine mechanisms that are intended to ensure that the concertina side walls of the bag remain interposed between the stiff parts of the machine bearing the coupling means.

At this point it is clear how the objects of the invention have been reached.

In particular a disposable container has been provided for valuable items to be used in a filling and closing machine without the need to provide welding means or complicated systems for irreversible closure. In fact, the container is provided at the mouth with coupling means that, when it is taken to the coupling position, achieves irreversible closure of the container. This enables the structure of the money-handling machine to be simplified in a significant manner.

Closing is firm and secure; in the event of opening following irreversible closure, the container is not reusable for subsequent closing and the opening by breaking the coupling means that has occurred is obvious.

Closing further occurs in a rapid manner in the machine and without the need for considerable energy to be used. The fact that the bag is disposable enables the costs of the logistical handling of the containers to be kept drastically low.

A machine has also been provided for filling and closing containers for valuable items that enables firm and secure closing to be assured in an automatic manner. Further, replacing the filled and sealed container with a new container is facilitated, owing to the fact that the bag is connected only on one side and automatically disengages from the movable support of the machine.

Naturally, the description made above of an embodiment applying the innovative principles of the present invention is given by way of example of such innovative principles and must not therefore be taken to limit the scope of what is claimed herein. For example, the shape of the bag could also be different from what is shown in the figures. The container can be closed manually by acting on the handwheel of the machine, or in an automatic manner by means of a suitable motor drive associated with the elements for closing the machine.

The invention claimed is:

1. A disposable container for valuable items that is suitable for being used in a machine for filling and closing the container, the container being suitable for being anchored to supporting elements of the machine, said machine comprising a filling mouth positioned for receiving valuable items coming from the machine, with an edge of the filing mouth comprising coupling means movable through action of closing elements of the machine from a first decoupled position, wherein the filing mouth is open, to a second coupled position, wherein the filing mouth is closed, said coupling means achieve an irreversible mechanical coupling when the filling mouth is taken to the second coupled position, said coupling means including at least a male element and a female element engaging one another to achieve said irreversible mechanical coupling.

2. The disposable container according to claim 1, wherein said coupling means is formed on two stiff parts of the container that are mutually movable.

3. The disposable container according to claim 2, wherein each of the two stiff parts bears anchoring means for anchoring to a respective supporting element of the machine.

4. The disposable container according to claim 2, further comprising a flexible bag provided with a filling opening, the two stiff parts are fixed to the flexible bag at opposite sides of the filling opening of the bag.

5. The disposable container according to claim 4, wherein along an opening edge of the bag, between the two stiff parts, there are fixed two foldable panels forming an angle facing inside of the container, thus by moving together the two stiff parts the opening edge is guided by the two foldable panels to remain interposed between the two stiff parts.

6. The disposable container according to claim 4, wherein one stiff part of the two stiff parts includes at least a rib along an extent thereof suitable for engaging in at least a corresponding groove in the other stiff part of the two stiff parts to prevent removal of the valuable items with the filling mouth closed.

7. The disposable container according to claim 2, wherein the coupling means includes elements protruding from one stiff part of the container suitable for being inserted irreversibly into respective seats of the other stiff part.

8. The disposable container according to claim 2, wherein a first stiff part of the two stiff parts has anchoring means for anchoring to the supporting elements of the machine and a second stiff part of the two stiff parts is connected in a movable manner to the former.

9. The disposable container according to claim 8, wherein the first stiff part forms a cornice having at least an inlet opening in the container and the second stiff part forms a door hinged on the cornice for closing said inlet opening.

10. The disposable container according to claim 9, wherein an upper edge of a bag, that forms a flexible portion of the container receiving the valuable items, is fixed to the cornice.

11. The disposable container according to claim 2, wherein a transponder is integrated on one of said two stiff parts.

12. The disposable container according to claim 1, further comprising anchoring means for anchoring the container to the supporting elements of the machine.

13. The disposable container according to claim 12, wherein said anchoring means includes holes suitable for being placed on pivots formed on the supporting elements of the machine.

14. The disposable container according to claim 1, further comprising a portion with a flexible wall for receiving the valuable items.

15. The disposable container according to claim 14, wherein a transponder is integrated on the flexible wall of the container.

16. The disposable container according to claim 14, wherein the flexible well includes a concertina portion that is expandable in an insertion direction of banknotes to achieve stacking of the banknotes.

17. The disposable container according to claim 16, wherein the concertina portion has a parallelepipedon shape with guide holes on corners of the parallelepipedon intended for receiving rods of the machine to control expansion of a bag.

18. The disposable container according to claim 1, wherein the irreversible mechanical coupling is achieved by a chemical substance that is associated with the coupling means so as to enter in action when the coupling means is taken to the second coupled position.

19. The disposable container according to claim 18, wherein said chemical substance is a glue or a solvent.

20. The disposable container according to claim 1, further comprising a transponder for storing and providing information that is useful for logistical management of the container.

21. The disposable container according to claim 1, further comprising several containing chambers for logical selection or separation of banknotes, with each of which there is associated a mouth that is closable by a respective mechanical coupling means.

22. The disposable container according to claim 21, wherein the irreversible mechanical coupling includes a cornice to which are fixed the flexible walls of a bag forming several containing chambers, the cornice forming several filling mouths that are closable in an irreversible manner by corresponding doors movably connected to a frame.

23. The disposable container according to claim 1, further comprising a flexible wall portion for receiving banknotes, said flexible wall portion having a filling opening, substantially an entire perimeter of an edge thereof is fixed to a cornice that bears the irreversible mechanical coupling and is flexible to be movable between an open position to receive the banknotes and a closed position wherein the irreversible mechanical coupling is irreversibly coupled.

24. The disposable container according to claim 23, wherein said cornice includes a ring element that is locally flexible in a plurality of points to enable passage from an open to a closed position.

25. The disposable container according to claim 24, wherein said cornice in the open position has a polygonal shape with a plurality of segments.

26. The disposable container according to claim 25, wherein the cornice in the open position has a hexagonal shape.

27. The disposable container according to claim 25, wherein each segment of the cornice has coupling means coupled with another corresponding segment of the cornice.

28. The disposable container according to claim 25, wherein the polygonal shape is sufficiently stiff at the segments thereof and has local flexure points at corners of the polygon.

29. The disposable container according to claim 23, wherein said cornice in a closed position has a substantially rectilinear shape.

30. A machine for filling and closing a disposable container of valuable items, said machine comprising supporting elements for supporting the container during filling and closing operations, means for filling the container supported by the supporting elements, and movable closing elements suitable for moving coupling means of the container from a decoupled position to a coupling position, said movable closing elements being hinged on a frame to form a filling channel for the valuable items moving towards a mouth of the container and being able to rotate and come into contact with a door hinged on a stiff cornice of the container and move the door coupled with the frame when the container is supported by the supporting elements to cause irreversible coupling of a mechanical coupling including at least a male element and a female element.

31. The machine according to claim 30, wherein said supporting elements are mounted in a slidable manner between a position for inserting/extracting the container from the machine and a position for filling and closing the container inside the machine.

32. The machine according to claim 30, further comprising automatic motor-driven driving means for moving the movable closing elements and achieving coupling of the mechanical coupling of the container.

33. The machine according to claim 30, further comprising a command element kinematically connected to the movable closing elements, said command element is accessible to the operator of the machine and is usable to command the mechanical coupling of the container.

34. The machine according to claim 30, wherein the container is arranged inside a safe when the container is supported by the supporting elements in a filling position.

35. The machine according to claim 30, further comprising automatic control means for commanding activation of the filling means and of the movable closing elements.

* * * * *